US005609731A

United States Patent [19]

Giertz et al.

[11] Patent Number: 5,609,731

[45] Date of Patent: Mar. 11, 1997

[54] PROCESS FOR GAS PRESSURE REGULATION IN THE RETORT OF A COKE OVEN

[75] Inventors: Hans J. Giertz, Ratingen; Werner Eisenhut, Essen; Friedrich Huhn, Ratingen; Hans J. Hammermann, Oer-Erkenschwick, all of Germany

[73] Assignee: Bergwerksverband GmbH, Essen, Germany

[21] Appl. No.: 367,120

[22] PCT Filed: Jul. 12, 1993

[86] PCT No.: PCT/EP93/01817

§ 371 Date: Mar. 2, 1995

§ 102(e) Date: Mar. 2, 1995

[87] PCT Pub. No.: WO94/01513

PCT Pub. Date: Jan. 20, 1994

[30] Foreign Application Priority Data

Jul. 14, 1992 [DE] Germany ..... 42 23 069
Jun. 30, 1993 [DE] Germany ..... 43 21 676

[51] Int. Cl.[6] ..... C10B 47/00

[52] U.S. Cl. ..... 201/35; 137/14; 137/487.5; 202/105; 202/256; 202/270

[58] Field of Search ..... 201/1, 35, 41; 202/105, 120, 255, 256, 270; 137/14, 38, 45, 487.5

[56] References Cited

U.S. PATENT DOCUMENTS

| | | | |
|---|---|---|---|
| 2,603,232 | 7/1952 | Keammerer | 202/256 |
| 3,243,360 | 3/1966 | Wethly | 202/256 |
| 3,580,815 | 5/1971 | Tucker | 202/270 |
| 3,876,507 | 4/1975 | Koddenberg et al. | 202/256 |

*Primary Examiner*—Robert J. Warden
*Assistant Examiner*—Krisanne M. Thornton
*Attorney, Agent, or Firm*—John Wade Carpenter

[57] ABSTRACT

A process is disclosed for regulating the gas pressure in the retort of a coke oven. Pivotable cup valves arranged in the elbows of the ascending pipe are actuated as throttling members according to the pressure curve resulting from gas formation from the coal to be cokefied. Throttling of each individual retort is effected by varying water supply, thus regulating the extent of submersion in water, and regulation follows actual pressure conditions in the retort of the coke oven.

6 Claims, 10 Drawing Sheets

PROCESS FOR GAS PRESSURE REGULATION IN THE RETORT OF A COKE OVEN

BACKGROUND OF THE INVENTION

1. Field of the Invention

The invention concerns a process for regulation of gas pressure of a coke oven retort.

2. Description of the Prior Art

DE-PS 955 681 discloses regulating gas pressure in the elbows of ascending pipes of coke oven batteries by means of throttling members which are coupled to a cam disk as a controlling element. In this, the geometry of the cam disk corresponds to the pressure ratios customarily to be expected. Through the rotational movement of the throttling member of the ascending pipe elbow, which takes place in small steps, the cross section of the ascending pipe is regulated from the beginning of the filling of the oven retort until the end of the coking time, corresponding to the pressure course during gas formation of the coal which is to be coked in order to constantly maintain a slight constant overpressure in the retort.

DE-AS 1 192 152 discloses a process for regulation of the gas pressure of a coke oven retort in which the cup shaped pivotable valves are activated as throttling members corresponding to the pressure increase during gas formation of the coal to be coked.

In this, regulation takes place via a control disk which completes one rotation for each gas formation period and is connected to the valve by a lever arm. In the horizontal position, the valve fills with water such that the effectively sealing fluid density known from coal carbonizing practice is maintained.

With these known regulating techniques, it is an advantage that all coke ovens of a battery solely can be controlled according to the default geometry of the cam disk as the control element. Regulation of the actually individual retort pressure dependent upon the gas release of the individual oven is not possible.

SUMMARY OF THE INVENTION

The task underlying the invention is to develop a process in order to individually regulate the gas pressure of each single coke oven retort dependent on the gas release and/or to influence the crude gas composition. Further, the task underlying the invention is to present a device for the implementation of the process.

This task is solved with reference to the process in accordance with the present invention in that the throttling for each individual oven takes place with a controllable water submersion and the regulation takes place in dependence upon the actual pressure ratio in the coke oven retort.

Further developments according to the process are characterized thereby in that the regulation of gas pressure takes place in the area of the maximal level of water submersion and thus the lingering period of the crude gas in the coke oven retort is increased. The process of the present invention is further characterized in that the regulation of gas pressure takes place in the area of the minimal level of water submersion and thus the lingering period of the crude gas in the coke oven retort is decreased. Regulatable water submersion is implemented in coke ovens with double collecting main operation. Pressure in the coke oven retort is regulated such that the pressure remains constant at the level of the retort minimal pressure which is known per se.

Solutions to the task of invention with reference to the device are characterized thereby in that the throttling member consists of a pivotable cup (1) which exhibits a gap (3). A floor (8) of pivotable cup (1) is formed as a cone and exhibits a run-off gap (7), which is interrupted by teeth (9). A plate (10) with an axis (11) and with an adjustable stop (12) is pivotably arranged beneath a submersion pipe (13). A pivotable cup (6) is designed with a funnel floor (61) with outflow apertures (62) and (63). A pivotable cup (70) with an outflow aperture (71) is equipped such that a purification mandrel (72) can be introduced with a downward swing. The edge of submersion pipe (13) is executed diagonally or is equipped with reliefs or openings. An ascending pipe elbow is furnished with an ascending pipe elbow extension (90) with out-flow aperture (91). Beneath an ascending pipe elbow extension (101) and arranged in the vertical direction is a movable pipe (102) which is sealed above a submersion (103) opposite the ascending pipe elbow extension (101). A collecting main (110) with an ascending pipe elbow extension (111) and a pivotable cup (112) is equipped with lines (113, 114 and 115) and a control device (117) for the water supply.

DETAILED DESCRIPTION OF THE INVENTION

Controllable water submersion of elbow members can be undertaken with the conventional pivotable cup. In this, the water feed into the pivotable cup must be regulatably designed. Through increased supply of water an additional submersion is formed within the submersion pipe (inner water submersion) additional to the usual submersion, which is regulatable by altering the water supply.

With the conventional pivotable cup, the water submersion cannot be reduced beneath the pivotable cup rim. A reduction of the submersion is thus possible in that the familiar pivotable cup is equipped with openings in or on the cup floor. It is further possible to use the cup floor as a deflector for a controllable water submersion within the submersion pipe. The collecting main valve designed as a butterfly valve can likewise be used for water submersion according to invention.

A pivotable cup modified opposite the conventional pivotable cup possesses for example a slit between the cup floor and cup rim through which not only water but also the condensate which has reached the submersion can flow off. During filling, the pivotable cup according to the invention is opened exactly like the conventional pivotable cup. It can even be closed from the beginning on with equal area in the construction of the annular gap opposite the cross section of the open ascending pipe elbow, as with this design, no throttling effect takes place.

Through this controllable water submersion, a separation of collecting main pressure and retort pressure is possible for the first time. By this, with identical suction cross section, better evacuation through a less collecting main pressure can be achieved as the retort pressure is no longer dependent upon collecting main pressure because of the separation through controllable water submersion. Further, known measures for emission reduction during the filling process can by omitted (press water suction, delivery tube and the blowing in of air in the leveling door, e.g. with a leveling coupling.

The maximal height of the water level within the submersion pipe can be limited through the design of the cross section of the water feed line, through a thermoelectric resistor or by a maximal pressure in the retort.

The clear separation between retort and collecting main pressure allows individual control of pressure within each single retort.

Additionally, by means of known pressure sensors, retort pressure can be measured for example at the foot of the ascending pipe, at the elbow, in the area of the door or at another suitable location. The pressure thus measured serves as a command variable for pressure regulation which takes place via altering the water supply to the water submersion.

Another possibility consists of using the crude gas volume stream as a command variable for the control.

Naturally, a pure control of pressure—without expected/actual value comparison—can be carried out, e.g. in case of loss of pressure measurement, depending upon the coking period, crude gas temperature in the ascending pipe or other suitable variable.

In accordance with the present invention, regulation of gas pressure can take place in the area of the maximal height of the water submersion. By increasing the submersion, the retort pressure can be increased in an intentional manner. The possibility of increasing the crude gas sojourn time is thereby created. Due to crack reactions, a crude gas compound results, e.g. with increased hydrogen content and reduced tar yield.

According to the present invention, gasses are evacuated with lesser collecting main pressure using an opened throttling member. In this, even a vacuum can prevail in the collecting main. This reduced collecting main pressure has the effect on the oven retort that the crude gas can escape more easily than before from the oven retort at the onset of the coking period and during coking, and by this, high pressures can be avoided in the retort. By this, it is possible to reduce retort pressure, which is dependent upon the higher collecting main pressure as known from the state of art, as now the lesser, possibly even negative collecting main pressure can be directly effective in the retort and leads by this to stronger evacuation with reduced crude gas transit time.

The abbreviation of the crude gas transit time leads to a preservation of the gaseous coal by-products. That means that, for example, the methane portion of the gas increases while the hydrogen fraction reduces. As a result of this, the combustion value, the crude gas density and the Wobbe index of the gas increases. Further, by lowering collecting main pressure, a more expeditious crude gas evacuation is effected. By this, the carbon humidity is evacuated more quickly from the retort charge and by this the specific energy use in coking is reduced.

Between the control conditions every desired water submersion can be set and controlled.

If gas pressure lessens in the oven retort as a result of changed crude gas release, the chamber pressure reduces itself to a gas pressure that can be set individually for each retort. If this prior determined chamber pressure is reached, a servomotor activates the pivotable cup and the open cross section in the gas path is thereby reduced. The pivotable cup does need not then be closed via a servomoter controlled by minimum retort pressure when, given an annular gap design, the pivotable cup is closed directly following the filling procedure. Water reaches the pivotable cup through the constantly flowing coal water of the collecting main trickier. The water in the pivotable cup rises up to a certain submersion height dependent on water off-flow through the outflow cross-section of the cup and dependent on the supplying water. By this, gas pressure in the coke oven increases in dependence upon submersion height. Submersion height can be regulated via the volume of water such that the pressure of the individual oven retorts is individually adjustable.

A submersion height limitation takes place through the rim height of the pivotable cup, i.e. when the coal water flows unregulated into the pivotable cup, and the superfluous water flows over the pivotable cup rim into the collecting main. By controlling the water supply volume each desired submersion height can be continuously adjusted such that, in a simple manner, the retort pressure for each individual coke oven is individually adjustable. The respectively present gas pressure is constantly measured and serves as a command variable for control over submersion. With this, the pressure in each retort is measured such that no ambient air can be drawn into the oven, i.e. that also on the furnace bottom a slight over pressure in the retort prevails.

Regulatable water submersion according to the invention can be used with advantage for operation of coke ovens with a double collecting main. The crude gas stream in the one or other collecting main is controlled via differing submersion heights; through this, collecting main pressure of both collecting mains can be different and adjusted independent of retort height. As a result of this independence of collecting main pressure from retort height, a lower collecting main pressure than previously absolutely necessary can be set or even a vacuum can prevail in the collecting main. Through this, additional suction over both collecting mains, e.g. a press water suction, is superfluous.

An increased crude gas evacuation can be reached via a collecting main pressure which is adjustable independent of retort pressure according to the invention and no longer requires the detour over an enlargement of the suction cross-section as with the previously unchangeable collecting main pressure. In spite of continual crude gas evacuation, it is always possible to maintain a minimum gas pressure in the oven and to securely prevent air penetrations into the oven retort in case of too little gas development.

Pressure in the coke oven retort can be regulated such that the pressure lies constant at the level of the retort minimum pressure which is known per se. By this method, as opposed to the conventional method, emissions from all oven leakages can be significantly reduced. In contrast to the usual method, in the method according to invention, the danger does not exist that the coke oven retort comes into vacuum and thus the danger of air penetration be present.

The pivotable cup according to invention can be variously formed, exactly as is the case for the ascending pipe elbow extension which serves as a submersion pipe, opposite the above mentioned design form. Water supply can likewise be achieved in various manners. The different design forms of the invention are explained following using the drawing.

BRIEF DESCRIPTION OF THE DRAWINGS

The drawing shows in

FIG. 1 a design of the pivotable cup according to invention, in

FIG. 1 shows a pivotable cup 1 with an axis 2 with which pivotable cup 1 can be turned. In horizontal position a submersion pipe 4 projects into pivotable cup 1 such that a submersion up to cup rim 5 of pivotable cup 1 is possible. In dependence upon supplied water volume, the water runs off either only via gap 3 or via gap 3 and upper cup rim 5. The water volume can be regulated such that every submersion height can be set between gap 3 and cup rim 5.

FIG. 2 shows a pivotable cup 6 with a floor 8 formed as a cone and run-off gaps 7 interrupted by teeth 9.

Figure 1:
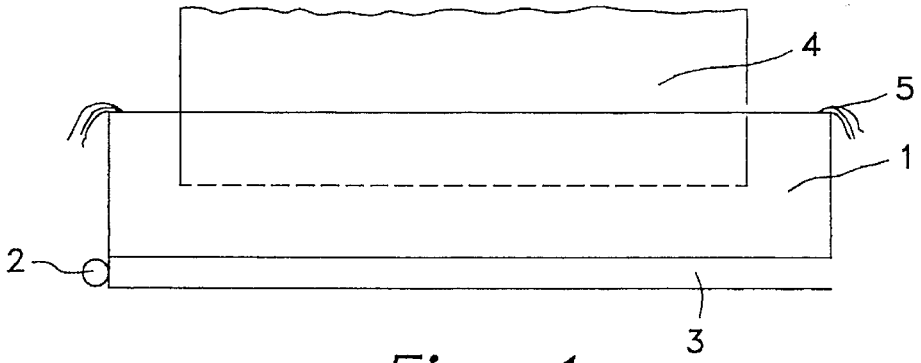
Figure 2:
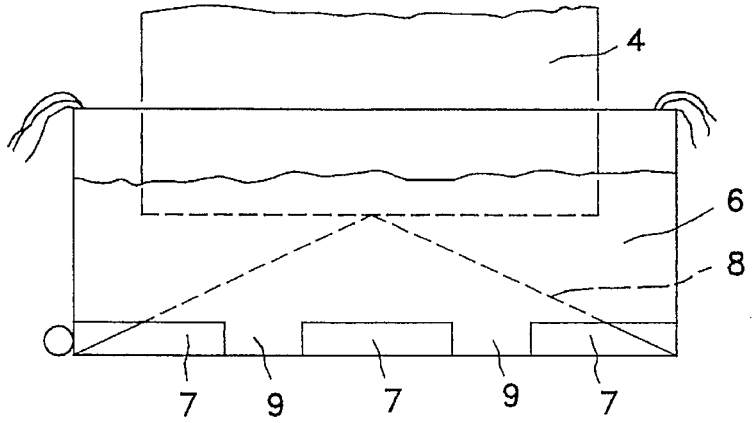
FIG. 2 a further design form of the pivotable cup according to invention, in FIG. 3 a design in which the throttling member is formed as a plate, in FIG. 4 the principle of gas pressure regulation of a coke oven retort with the pivotable cup according to invention, in FIG. 5 the principle of a water immersed double collecting main operation of a coke oven, in FIGS. 6 and 7 further design forms of cups according to invention, in FIG. 8 various possibilities of ascending pipe elbow extension, in FIG. 9 a design of water submersion according to invention, in FIG. 10 a further possibility of retort pressure regulation according to invention, in FIG. 11 a special design form of water regulation for water submersion according to invention, and in FIG. 12 the dependence of retort pressure on the coking period.
Figure 3:
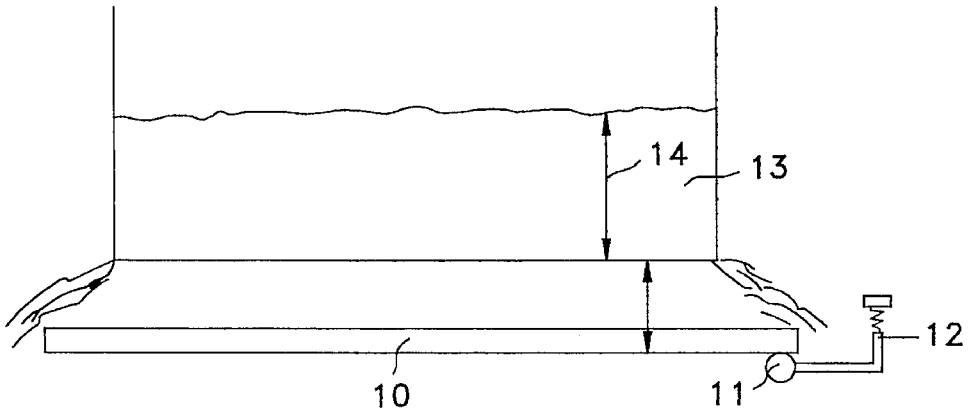
FIG. 3 shows a plate 10 which can be pivoted with an axis 11 with an adjustable stop 12 beneath a submersion pipe 13. By means of a water supply not depicted, an arbitrary water level 14 in submersion pipe 13 can be set.
Figure 4:
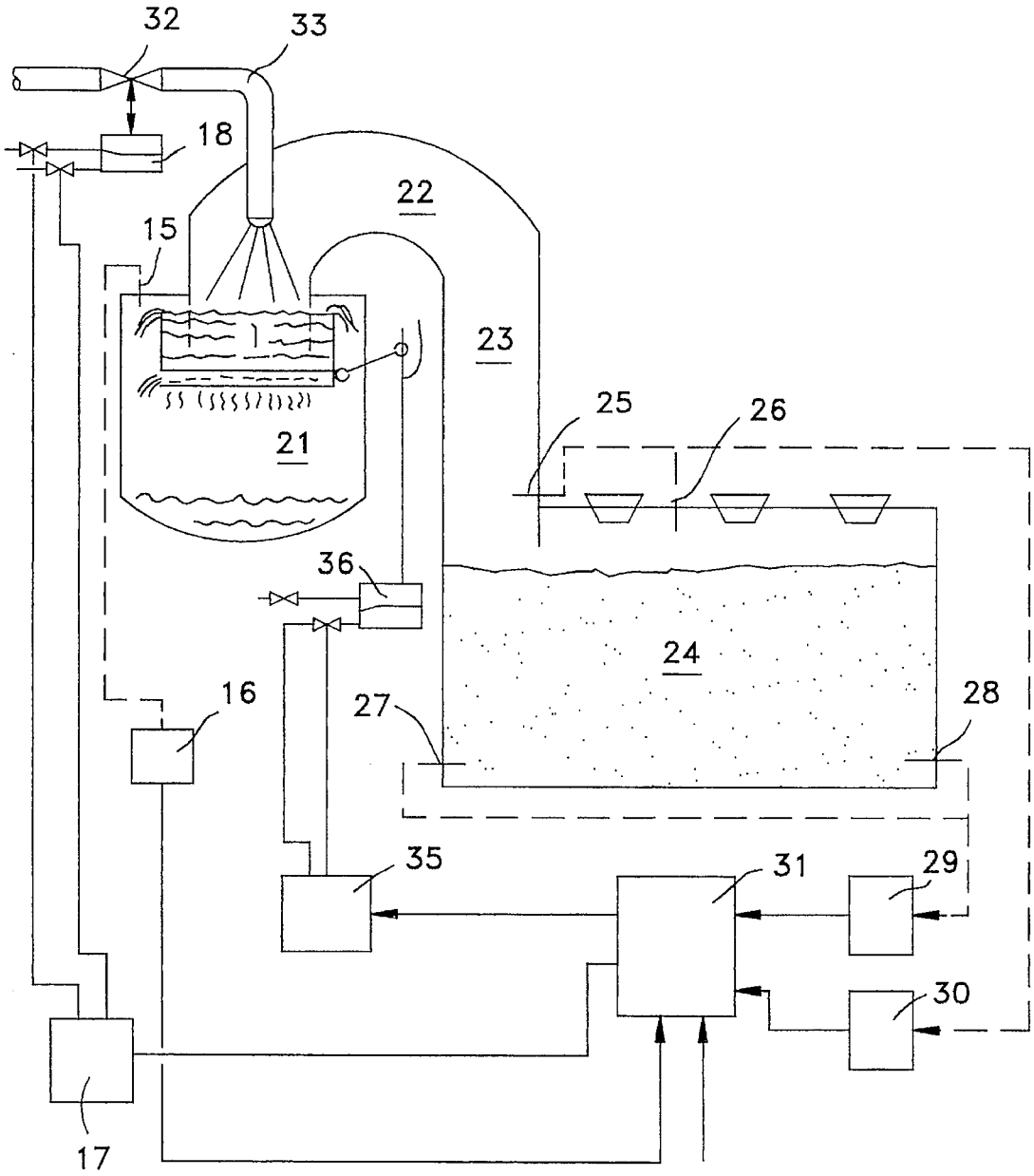
In FIG. 4 is depicted the process for regulation of the gas pressure of a coke oven retort. From FIG. 4 proceeds that pivotable cup 1 according to invention is arranged in a collecting main 21 on which an ascending Pipe 23 is connected via an ascending pipe elbow 22. The ascending pipe is connected in the usual manner to an oven retort 24. Located on collecting main 21, ascending pipe 23 and oven retort 24 are pressure measuring points 15, 25, 26, 27 and 28 which are connected to a computer 31 via pressure transducers 16, 29, and 30. Via computer 31, a valve 32 of a coal water line 33 is adjustable with a regulator 17 and an actuator 18.

At the beginning of the coking period, the pivotable cup 1 is open and the pressure from collecting main 21 effects oven retort 24 via the ascending pipe elbow 22 and ascending pipe 23. The emerging crude gas can thus be suctioned from the oven retort 24. If the gas pressure sinks at pressure measuring points 25, 26, 27, or 28 beneath a limit value default in the computer, pivotable cup 1 will brought into a horizontal position via the controller 35, an actuator 36 and a rod. Into pivotable cup 1 now runs water from line 33 whereby the pressure in the the oven retort rises. If retort pressure reaches a default limit value in computer 31, the water supply via valve 32 is reduced far enough that the submersion in pivotable cup 1 sinks until that retort pressure present corresponds to the desired value. In this manner, dependent upon the desired retort pressure, the submersion can climb from 0 mm to the maximal submersion to the height of the cup rim or, respectively, to the internal submersion height limit, as possibly a too great a dose of water runs over the cup rim into the collecting main.

If the regulation of the submersion level fails, no water can run into the oven and the retort pressure can climb to the value corresponding to the greatest internal submersion level.

If no retort pressure reduction beneath the submersion rim level construction conditioned default pressure value is desired, the water supplied can be in operation unreduced. A constant overpressure thus sets itself without regulation preventing entry of ambient air into the coke oven.

Figure 5:
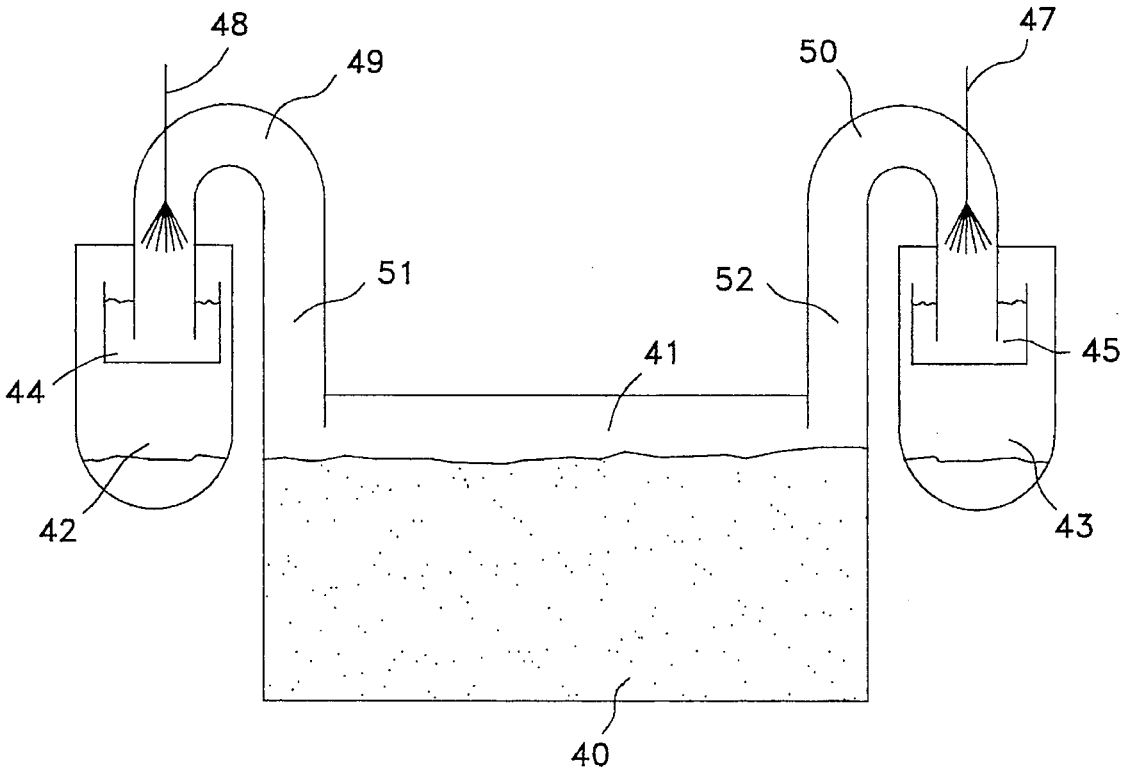

In FIG. 5 is depicted the principle of a double collecting main operation of a coke oven with water submersion according to invention.

From the figure proceeds that connected on a coke oven 40 with a gas collection space 41 are two collecting mains 42 and 43 via ascending pipes 51 and 52 as well as ascending pipe elbows 49 and 50. In both collecting mains 42 and 43 are arranged pivotable cups 44 and 45 which can be charged with water via collecting main tricklers 47 and 48.

At the beginning of the coking period, the pivotable cup 44 is completely open and pivotable cup 45 closed, i.e. arranged in the horizontal position. The crude gases present in coke oven 40 reach the collecting main 42 via the gas collection space 41, ascending pipe 51 and ascending pipe elbow 49 by means of open pivotable cup 44. Simultaneously, pivotable cup 45 is in the horizontal position. By this, coke oven 40 is separated from collecting main 43 through submersion in pivotable cup 45. Both collecting main tricklers 47 and 48 are simultaneously in operation.

If the crude gas composition changes from a desired crude gas quality in the course of the coking period, collecting main 42 can be separated by means of rotation of pivotable cup 44 into the horizontal position and collecting main 43 be connected by rotation of pivotable cup 45.

If both pivotable cups 44 and 45 are brought into the horizontal position, control can follow through raising or lowering the submersion on the basis of the lowering or raising of the water supply. As a result of the increase of pressure through raising the submersion, e.g. in the pivotable cup 44 of collecting main 42, the raw gas is suctioned off through collecting main 43 with less submersion in pivotable cup 45.

By this, the so-called connection or disconnection of both collecting mains 42 and 43 takes place dependent on crude gas composition, retort pressure and developed crude gas volume or in dependence on the coking period. The water level in the pivotable cups 44 and 45 can be set,—as previously described, —to the desired submersion level and the retort pressure thus be held to a desired value. By means of sufficient vacuum in the connected collecting main during the filling process, one can omit a previously necessary additional suctioning of the filling gases with press water or a transfer pipe.

Figure 6:
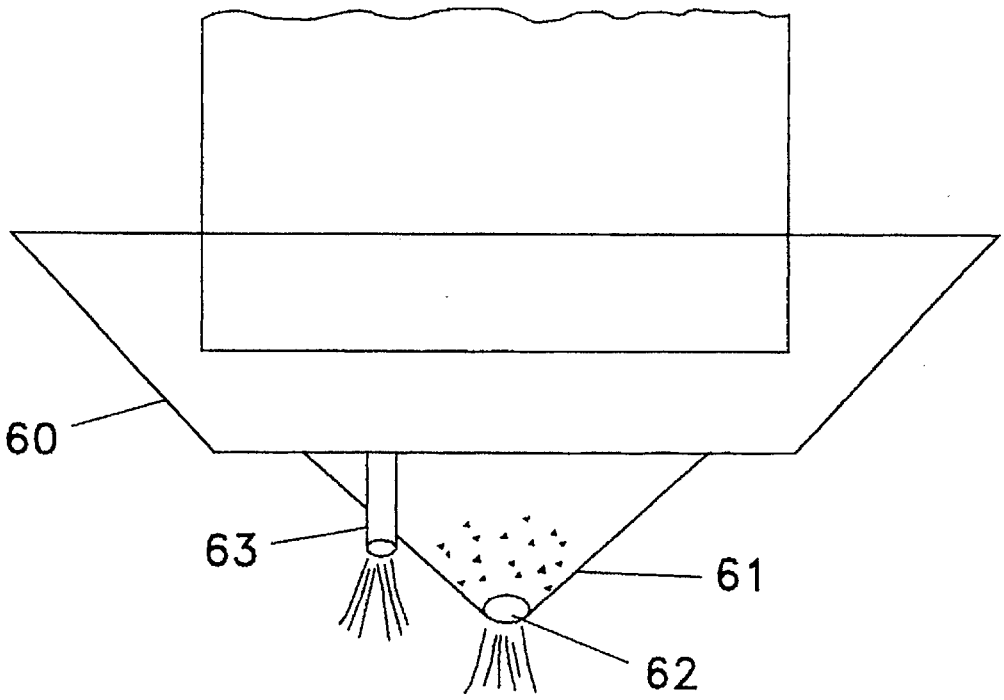

FIG. 6 shows a further design form of the pivotable cup according to invention. From the figure proceeds that a pivotable cup 60 is designed with a funnel bottom 61. Funnel bottom 61 is equipped with outflow apertures 62 and 63. Outflow apertures 62 and 63 are positioned at different heights. From the lower outflow aperture 62 run the heavy condensate elements and water, from the upper outflow aperture 63, the lighter condensation elements and water.

With pivotable cup 60, heavy condensation elements can continually be directed to outflow aperture 62. By means of water run off 63, the water level in pivotable cup 60 can be held at a defined level.

Figure 7:
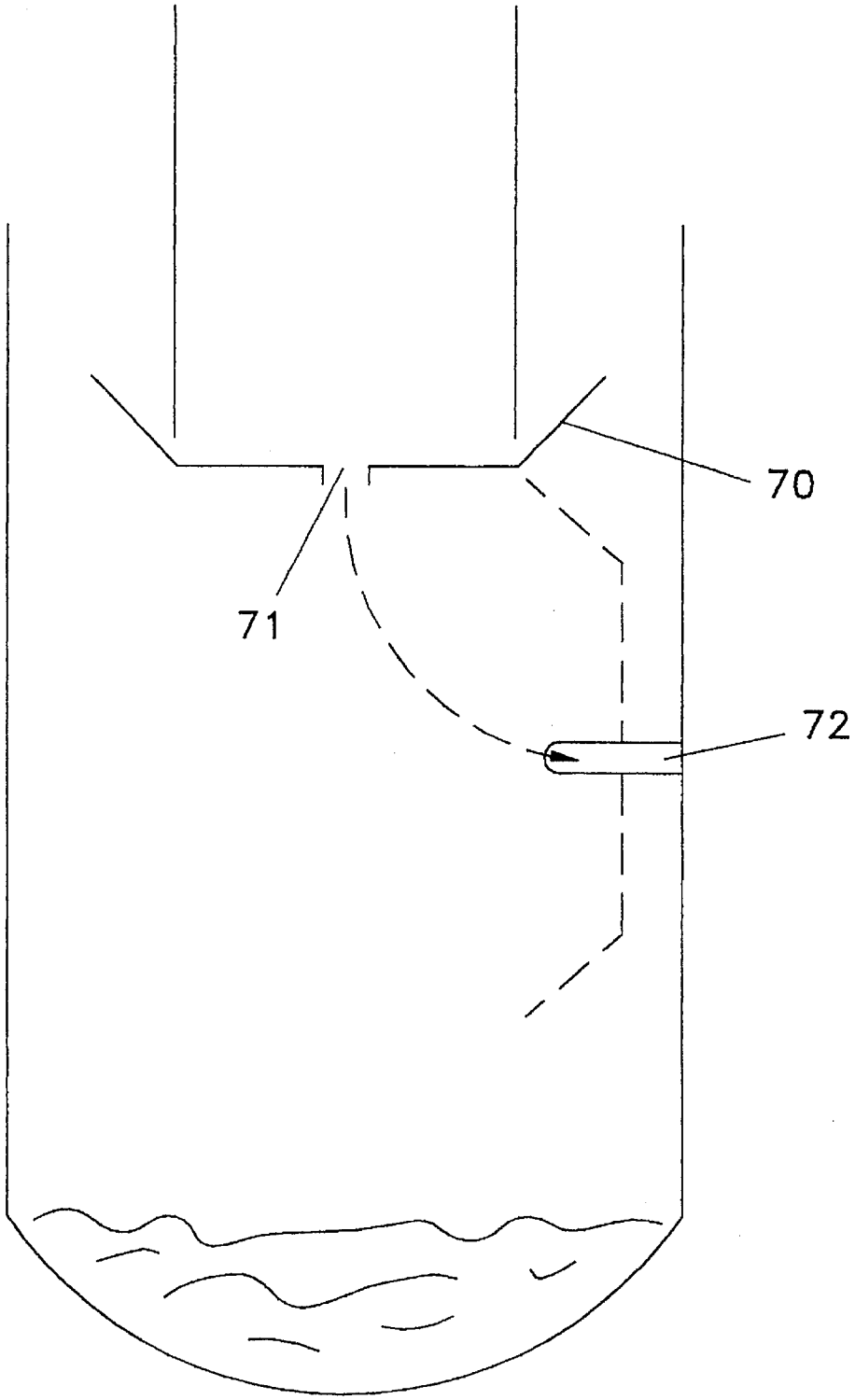
Figure 8A:
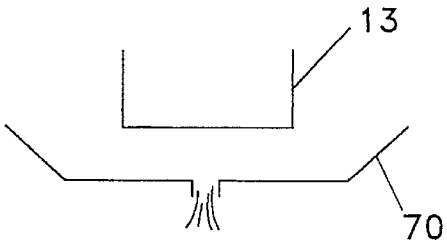
Figure 8B:
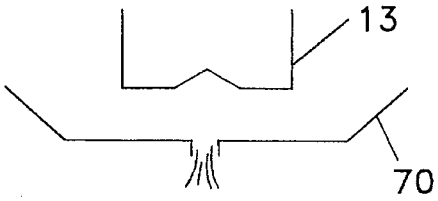
Figure 8C:
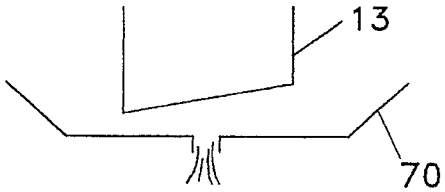
Figure 8D:
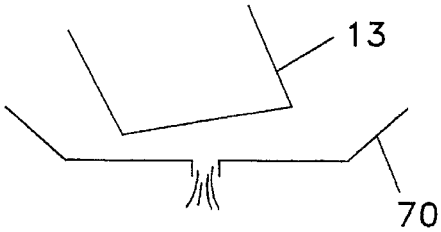
Figure 8E:
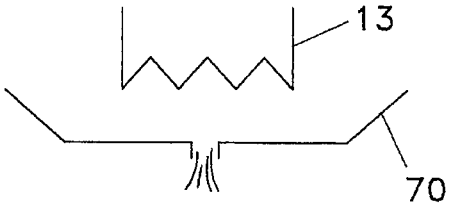
Figure 8F:
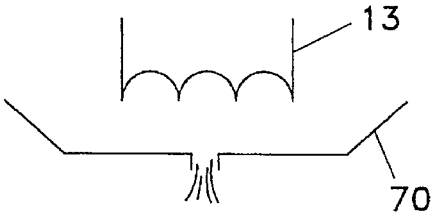
Figure 8G:
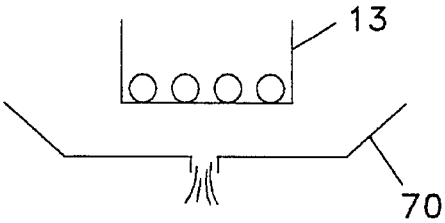

In FIG. 7 is depicted an additional design form of the pivotable cup according to invention. A pivotable cup 70 exhibits an outflow aperture 71. If pivotable cup 70 is swung downward, e.g. for the filling process, outflow aperture 71 is automatically freed from possibly adhering deposits by a purification mandrel 72. Obviously, these design forms can also be equipped with several outflow apertures and correspondingly several purification mandrels.

In FIG. 8 are depicted different possibilities of the form of the ascending pipe elbow extension which function as submersion pipe 13. In these design forms, the edge of submersion pipe 13 are modified such that a completely parallel edge to the water level of the pressure regulation water is no longer present as with the previously described design forms. In experiments, it became clear that a parallel edge to the water level leads to overshooting the pressure regulation and to a pulsation of the submersion.

If the edge is designed as depicted in FIG. 8 (*b–g*), a sudden complete submersion is hindered if the rising water level reaches the edge: Over shooting the pressure regulation is avoided.

Figure 9:
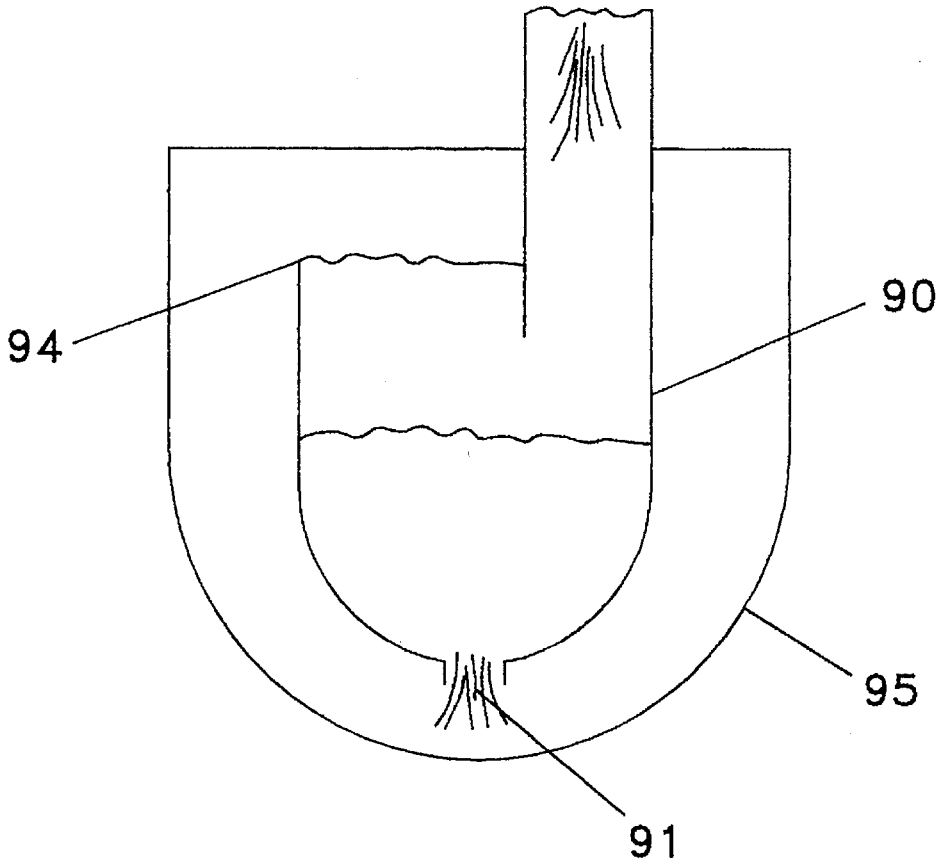

In FIG. 9, a design of the water submersion according to invention is depicted in which the pivotable cup according to invention is completely omitted. The water submersion is reached by means of a U shaped extended ascending pipe elbow. The U shaped ascending pipe elbow extension 90 is equipped with an outflow aperture 91 for condensate and water. The crude gas reaches collecting main 95 via the ascending pipe elbow and the ascending pipe elbow extension 90. If the retort pressure sinks, the inflowing water volume can be increased by increased water supply via the ascending pipe and the water level in ascending pipe elbow extension 90 thereby raised and the free gas escape cross section reduced. This reduction of cross section can be increased to the complete closure of the U pipe cross section up to overflow edge 94. With this device, control of gas pressure according to the invention is possible without the pivotable cup.

Figure 10:
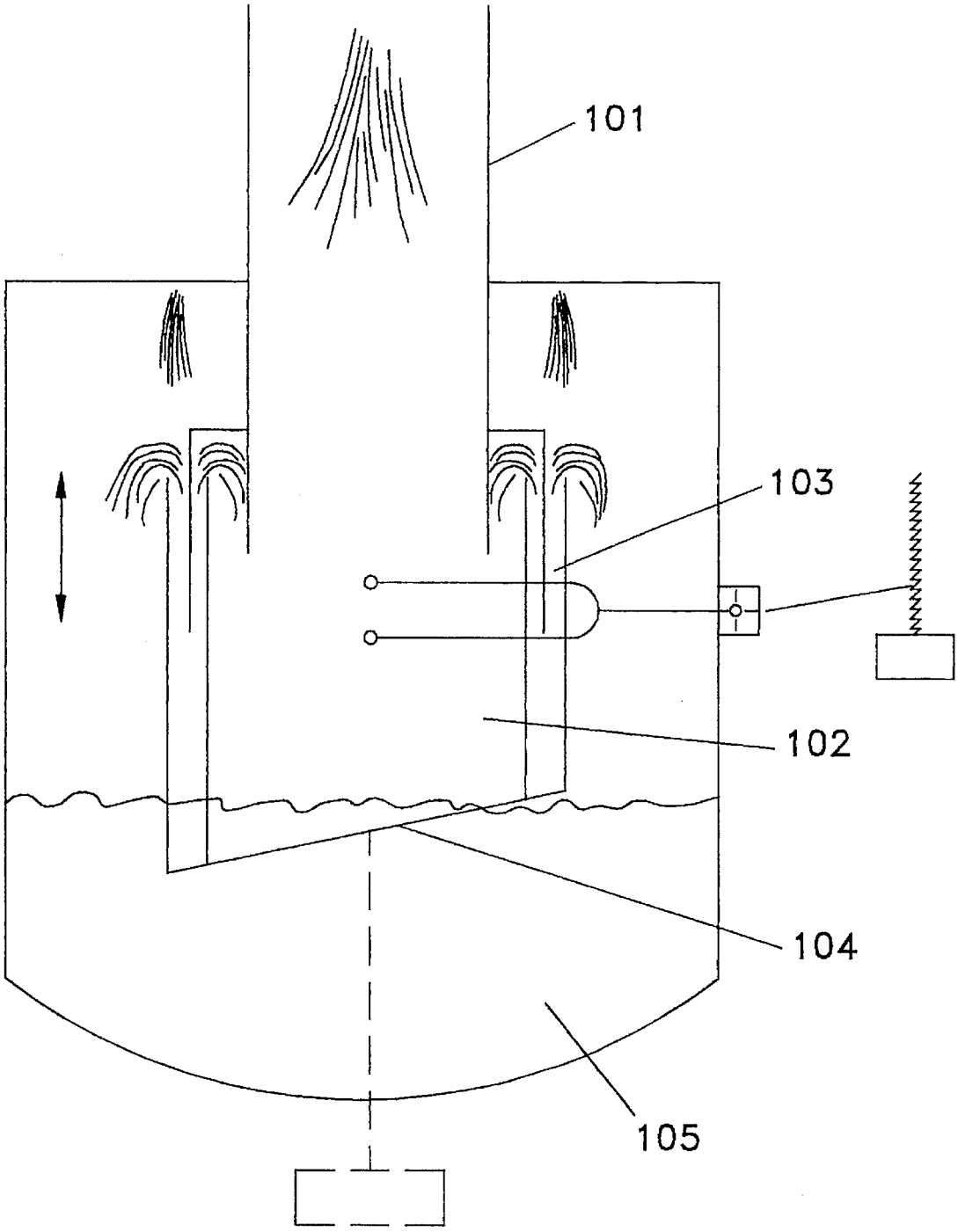

In FIG. 10 is depicted a further possibility of retort pressure control according to the invention. Beneath an ascending pipe elbow extension 101 is arranged a pipe 102 movable in the vertical direction which is sealed off opposite ascending pipe elbow extension 101 by means of an submersion 103. Pipe 102 is designed with an edge 104 corresponding to the design form of FIG. 8. This edge 104 immerses in collecting main sump 105. The retort pressure control according to the invention takes place through differential submersion of pipe 102 into collecting main sump 105. By this, pipe 102 can assume every position between "not immersed" to "fully immersed". The retort pressure control takes place thus by means of a lift control of pipe 102.

The advantage of this design is that a fully free and constant pipe cross section is present for condensate and crude gas. By this no blockage problems emerge during condensate run-off. The water level is constant independent of any control of the water supply. There are no closing sealing elements present. The seal between ascending pipe elbow extension 101 and pipe 102 takes place via a seal-free functioning water submersion. Due to the construction of the water submersion, no fixed or fragmenting condensate elements from the ascending pipe elbow extension can reach the submersion. The lifting direction for pipe 102 can be arranged from the side, from above or from below pipe 102.

Figure 11:
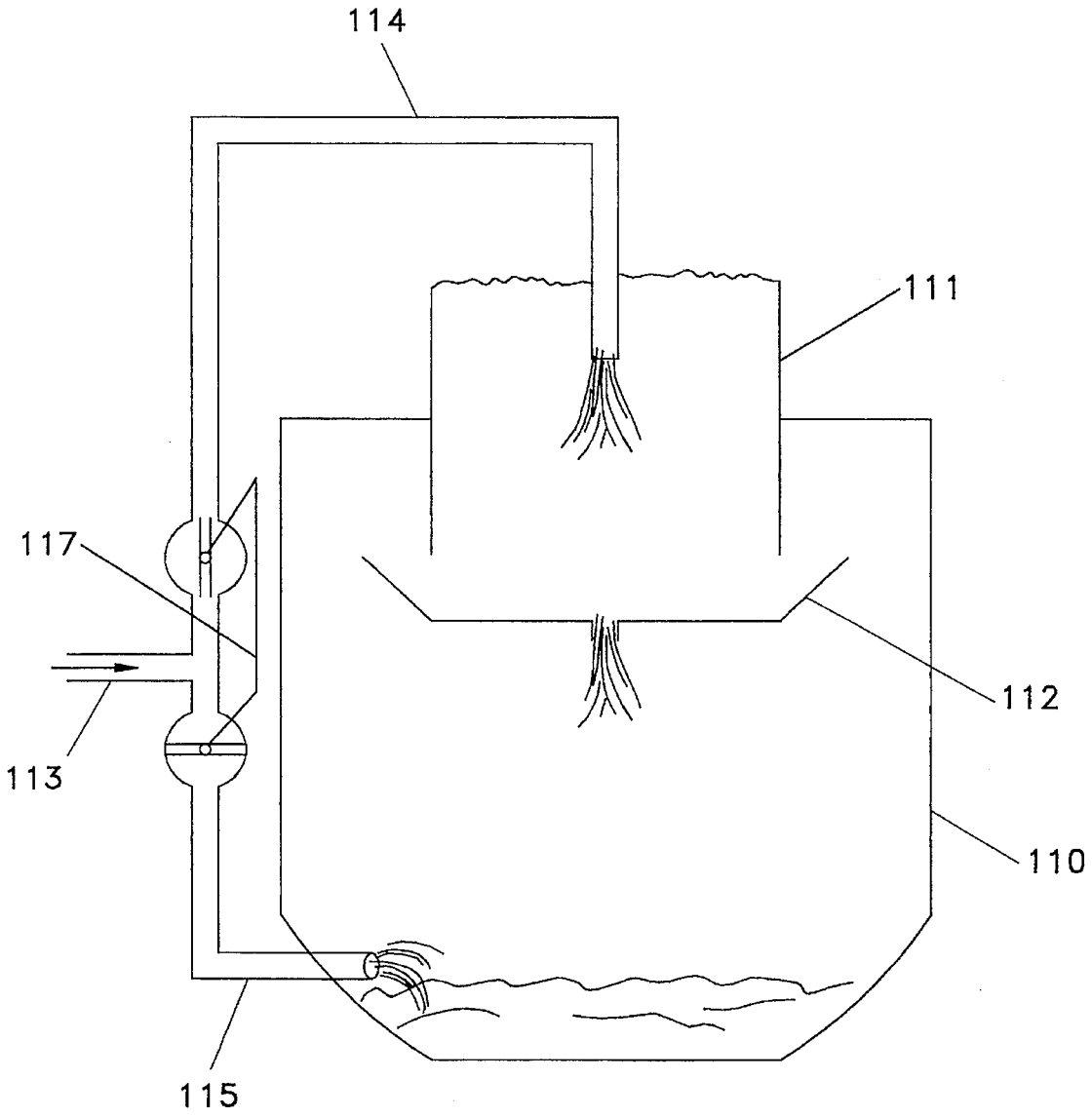

In FIG. 11 is depicted a special design form of the water control for the water submersion according to invention. A collecting main 110 with an ascending pipe elbow extension 111 and pivotable cup 112 is supplied with trickling water via a line 113 and 114. This trickling water can, as already described, be used for water submersion according to invention. The water fraction which is not required at the respective point in time for immersion, is led directly into the collecting main by a line 115. By this it is ensured that the total delivered water volume always reaches the collecting main without throttling and thus the necessary water volume for condensation transportation is always available in the collecting main sump. The distribution of the water streams takes place via a control device 117 and is arbitrary. What must only be insured is that a minimal amount of trickling water for crude gas cooling is available.

The advantage of this design form lies in that now pump energy is throttled for control purposes. The pumps for water supply always run with the same load. Possible leaks within the isolating valves are unproblematic and the sealing elements of the isolating valves are subjected to a slight pressure as the water supply does not need to be throttled.

Figure 12:
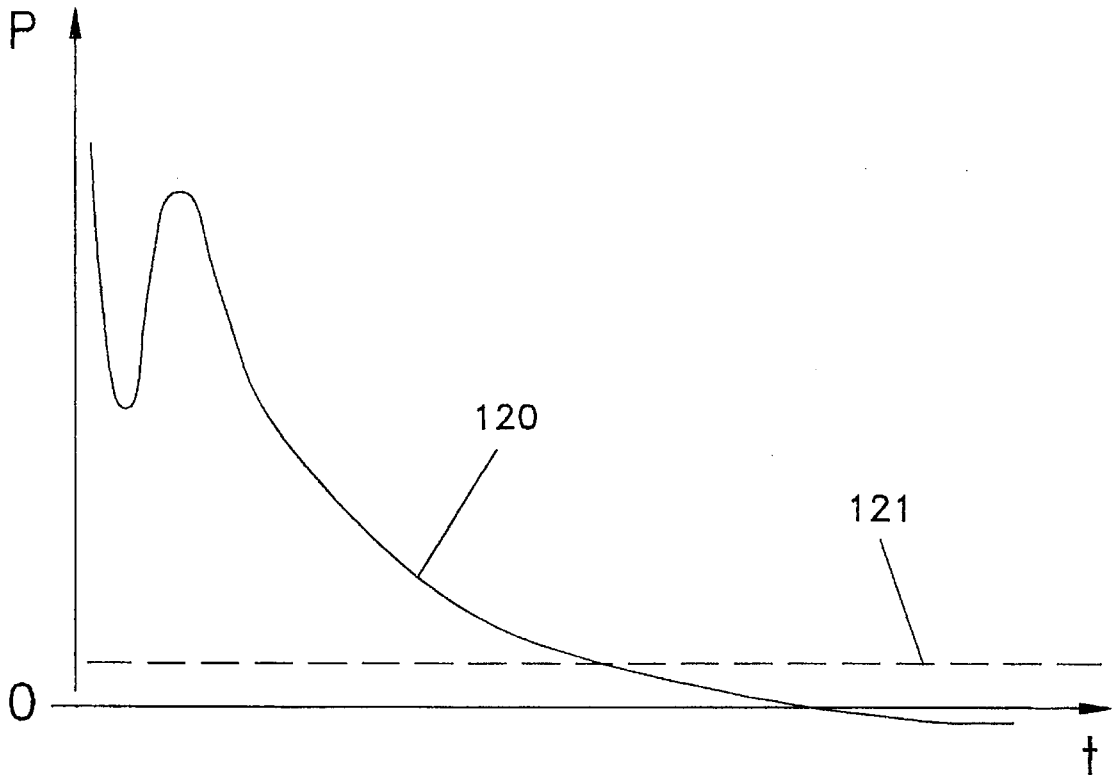

In FIG. 12, retort pressure P is depicted dependent upon the coking time t. Curve 120 shows the course of the retort pressure over the coking period consistent with the state of technology. In curve 121 is a modified course of the retort pressure during the coking period. This course is made possible through water submersion according to invention if the collecting main is operated not in overpressure, as previously necessary in coking operation, but rather in vacuum. With this procedure the retort pressure is modified so far that the pressure lies constantly at the level of the desired minimum retort pressure. This minimum pressure is to be measured such that no ambient air enters the oven near the end of coking.

By this change in process of the collecting main in the suction area, the emissions from all oven leaks are significantly reduced compared to the conventional process of the method.

By sinking the retort pressure to a minimum pressure from the onset of coking to the end, the previously identified additional differential pressure between the respective pressure within and without the retort is reduced. By this, the cause of occurrence of coke oven emissions falls away although the number and size of the leakage locations remains the same. Without further sealing measures, an emission behavior of the coke oven is achieved over the entirety of the coking time as previously was the case only at end of coking due to progressive coking and the associated lesser gas development and pressure decrease.

In operation with the pivotable cup according to invention with this procedure, the pivotable cup is constantly in the horizontal position. Only during the filling process is the pivotable cup swung into the vertical direction.

We claim:

1. In a process for regulation of the gas pressure of a coke oven retort in which pivotable cup valves arranged in elbows of an ascending pipe are actuated as throttling members according to a pressure curve resulting from gas formation from the coal to be cokefied wherein the improvement comprises varying a supply of water to the pivotal cup valve to regulate the extent of submersion of the elbows in water and to further regulate gas pressure within the coke oven retort.

2. The improved process according to claim 1 wherein the regulation of gas pressure takes place in the area of the level of maximal water submersion of the elbows to increase the lingering period of crude gas in the coke oven retort.

3. The improved process according to claim 1 wherein the regulation of gas pressure takes place in the area of the level of minimal water submersion of the elbows to decrease the lingering period of crude gas in the coke oven retort.

4. The improved process according to claim 1 wherein the pressure in the coke oven retort is regulated such that the pressure remains constant at the level of the retort minimal pressure which is known per se.

5. In a coke oven retort having at least one throttling member communicating with the gas pressure in the coke oven retort through elbow members in order to regulate the gas pressure the improvement comprises said throttling member comprising a pivotable cup (1), and said pivotable cup (1) includes a floor (8) formed as a cone.

6. The improved coke oven retort according to claim 5 characterized thereby in that a second pivotable cup (6) is provided with a funnel floor (61) with outflow apertures (62) and (63).

* * * * *